United States Patent [19]

Frondorf

[11] 4,047,386

[45] Sept. 13, 1977

[54] PROCESS FOR HEATING CONDENSATE

[75] Inventor: William A. Frondorf, Brownsville, Pa.

[73] Assignee: SCM Corporation, New York, N.Y.

[21] Appl. No.: 694,774

[22] Filed: June 10, 1976

[51] Int. Cl.[2] ..... F01K 7/38

[52] U.S. Cl. ..... 60/654; 60/678

[58] Field of Search ..... 60/670, 677, 678, 679, 60/680, 681, 654

[56] References Cited

U.S. PATENT DOCUMENTS

| | | | |
|---|---|---|---|
| 3,173,267 | 3/1965 | Takeda | 60/678 |
| 3,226,932 | 1/1966 | Strohmeyer, Jr. | 60/678 X |
| 3,300,974 | 1/1967 | Reed et al. | 60/678 X |
| 3,423,933 | 1/1969 | Knizia | 60/678 X |
| 3,842,605 | 10/1974 | Tegtmeyer | 60/678 |
| 3,972,196 | 8/1976 | Silvestri, Jr. | 60/670 X |

*Primary Examiner*—Allen M. Ostrager
*Assistant Examiner*—Stephen F. Husar
*Attorney, Agent, or Firm*—Richard H. Thomas

[57] ABSTRACT

A minor portion of low pressure exhaust vapor such as exhaust steam is compressed to a temperature above that which a major part of said exhaust vapor is being condensed, suitably by a centrifugal compressor driven by higher pressure vapor from the same source as that which powers a principal turbine that furnishes most of said exhaust vapor. The major part of said exhaust vapor is condensed and the resulting main condensate is passed into heat exchange with the compressed minor portion of the exhaust vapor for generating a heated resulting main condensate and a secondary condensate from condensation of the compressed exhaust vapor. These condensates are withdrawn, suitably for deaeration when the vapor used is steam.

4 Claims, 1 Drawing Figure

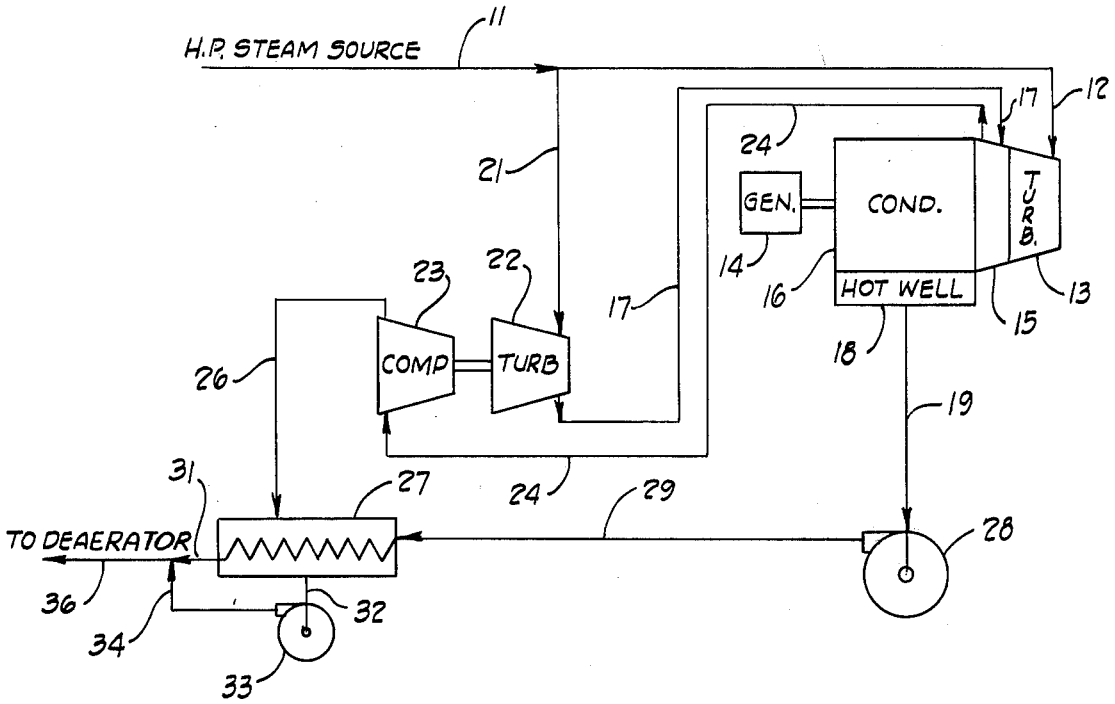
H.P. STEAM SOURCE
11
12
17
24
21
GEN.
COND.
TURB.
14
16
HOT WELL
13
15
23
22
17
18
COMP
TURB
26
19
31
27
24
29
28
TO DEAERATOR
36
32
34
33

PROCESS FOR HEATING CONDENSATE

This invention relates to a process for heat recovery and, more particularly, to a process for heating the condensate of readily condensable vapor such as steam, a halogenated hydrocarbon (eg., a "Freon," the trademark of E. I. du Pont de Nemours & Co.), diphenyl-diphenyl oxide mixtures, mercury, and other familiar heating vapors. It is particularly adapted for heat recovery in the 100°-200° F. range, most particularly from steam-using apparatus.

Advantages of the present invention over prior proposals include an increase in efficiency of about 3-5% in modest size power genrating plants such as those using steam turbogenerators.

Basically this process is one for heating the condensate resulting from condensing a supply of exhaust vapor into a primary liquid condensate, eg. for use as preheated boiler feed water. A minor portion of said exhaust vapor, typically 1-2% or even more, is compressed to a termperature above that which the major portion of said exhaust vapor is being condensed ($T_1$ being the condensing temperature of said major portion and $T_2$ being the condensing temperature of said minor portion). The major portion of condensate (primary liquid condensate) is passed into heat exchange with the compressed minor portion of exhaust vapor for warming said primary liquid condensate and condensing said compressed vapor to form a secondary liquid condensate from the latter. Both the warmed primary condensate and such secondary condensate formed by this heat exchange are withdrawn from their heat exchanging operation. Ordinarily they are reused. In the case where the vapor is steam and the condensates are water, the condensates are sent to deaeration in conventional fashion for reuse, eg. as boiler feed water.

The drawing is a flow diagram serving as the basis of design for a modest size turbogenerator operation for the generation of electricity using 100,000 pounds per hour of superheated 650 psia steam fed to the operation at 325° F. (H = 1418.8 BTU/pound). The equipment is conventional. Instruments, controls, and valves are not shown, but are to be provided conventionally where necessary or desirable.

This high pressure steam feed enters the system through line 11; 98,500 pounds per hour of it is fed by line 12 into primary turbine 13. Turbine 13 drives electric generator 14.

Simultaneously, 1,500 pounds per hour of the high pressure steam feed (2,250,000 BTU/hour) is bled from line 11 through line 21 and into turbine 22. This drives centrifugal compressor 23. Exhaust steam from primary turbine 13 flows into plenum 15, along with exhaust steam from secondary turbine 22, which latter exhaust steam enters the plenum through line 17. Exhaust steam for suction to compressor 23 is withdrawn through line 24 from plenum 15 (5,000 pounds per hour of vapor having 4,950,000 BTU).

The remainder of the exhaust steam from the two turbines is condensed in condenser 16 operated at 2 inches of mercury absolute pressure to yield a primary liquid condensate at 100° F. This condensate passes into hot well 18, thence through line 19 into the suction of condensate pump 28.

Compressor 23 compresses the minor portion of exhaust steam flow to a temperature of 161° F. at 10 inches of mercury absolute pressure (accounting for 5,500,000 BTU/hour, having H = 1,100 BTU/pound). The resulting compressed steam flow is fed by line 26 into the shell of heat exchanger 27. Here it warms the primary condensate flow (containing 95,000 BTU/hour) entering the tubes of heat exchanger 27 though line 29 at 100° F.

Warmed primary condensate from heat exchanger 27 is withdrawn through line 31; a secondary liquid condensate resulting from condensation of the compressed minor portion of exhaust steam is withdrawn from the shell of condenser 27 by means of line 32. This secondary condensate is pumped by condensate pump 33 and discharged through line 34 into admixture with the warmed primary condensate from line 31. The two condensate flows are withdrawn together through line 36 at 158° F. for providing a total of 100,000 pounds per hour for deaeration.

As will be apparent to one skilled in the art, in place of turbines any sort of steam engine drive (eg., reciprocating) can be used, and primary turbine 13, generator 14, and condenser 16 can be other conventional steam-condensing apparatus such as a heat exchanger or plurality of same in staged array. The vapor compression can be done in any conventional compressor such as a reciprocating one. However centrifugal drives and compressors are preferred for efficiency and economy, and multistage turbines and compressors likewise are advantageous. The heat exchange represented by item 27 preferably is done indirectly, but it can be done by direct exchange where desired.

I claim:

1. A process for heating a primary liquid condensate which results from condensing a supply of exhaust vapor from a primary turbine which comprises: compressing a minor portion of said exhaust vapor, the compressing of said minor portion being powered by a secondary turbine, the source for the secondary turbine being the same as that for the primary turbine; exchanging heat between said primary liquid condensate and the resulting compressed minor portion of exhaust vapor prior to any other heating of said primary liquid condensate; withdrawing from said heat exchanging the heated primary liquid condensate and a secondary liquid condensate resulting from condensation of said compressed vapor.

2. The process of claim 1 whrein said supply of exhaust vapor is steam, part of said supply of exhaust vapor is withdrawn from a primary steam turbine, the compressing of said minor portion of said exhaust vapor is powered by a secondary steam turbine, steam withdrawn from said secondary turbine is exhausted into admixture with exhaust steam from said primary turbine, and the withdrawn condensates are mixed after said heat exchanging.

3. The process of claim 2 wherein both condensings are done at subatmospheric pressure, and the mixed withdrawn condensates are deaerated.

4. The process of claim 3 wherein the primary steam turbine powers an electric generator, and the secondary steam turbine drives a centrifugal compressor for providing compression of said minor portions of exhaust vapor.

* * * * *

UNITED STATES PATENT AND TRADEMARK OFFICE

CERTIFICATE OF CORRECTION

PATENT NO. : 4,047,386

DATED : September 13, 1977

INVENTOR(S) : William A. Frondorf

It is certified that error appears in the above-identified patent and that said Letters Patent are hereby corrected as shown below:

Col. 1, line 15, change "genrating" to --generating--; line 22, change "termperature" to --temperature--; line 42, change "325°F." to --825°F.--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*